United States Patent [19]

Sato et al.

[11] Patent Number: 4,564,785

[45] Date of Patent: Jan. 14, 1986

[54] ENVELOPE STRUCTURE FOR FLAT CATHODE RAY TUBE

[75] Inventors: Hiroki Sato, Chiba; Takehisa Natori, Fujisawa; Takao Nakano, Yokohama, all of Japan

[73] Assignee: Sony Corporation, Tokyo, Japan

[21] Appl. No.: 604,611

[22] Filed: May 2, 1984

Related U.S. Application Data

[63] Continuation of Ser. No. 322,269, Nov. 17, 1981, abandoned.

[30] Foreign Application Priority Data

Nov. 26, 1980 [JP] Japan ..... 55-168938

[51] Int. Cl.[4] ..... H01J 29/86

[52] U.S. Cl. ..... 313/422; 313/477 R; 313/317; 428/13; 428/34; 445/22

[58] Field of Search ..... 313/422, 317, 324, 477 R, 313/493; 220/2.1 A, 2.3 A; 445/22; 174/17.05; 428/13, 34, 256, 432

[56] References Cited

U.S. PATENT DOCUMENTS 3,890,541 6/1975 McCarthy et al. ..... 313/422 X 4,325,489 4/1982 Russell et al. ..... 313/422 X 4,339,482 7/1982 Glaser et al. ..... 428/256 X 4,339,694 7/1982 Ohkoshi et al. ..... 313/422 X

*Primary Examiner*—David K. Moore

*Assistant Examiner*—K. Wieder

*Attorney, Agent, or Firm*—Hill, Van Santen, Steadman & Simpson

[57] ABSTRACT

A flat type cathode ray tube is disclosed which includes a flat envelope formed of a flat panel and a dish-shaped funnel, a first deflection system composed of a back electrode and a phosphor screen which are both located within the envelope in opposing relation with each other, a neck portion coupled to the envelope, the neck portion extending in the surface direction of the flat envelope having therein an electron gun, and a second deflection system formed of electro-static deflection plates which are so located within the envelope that they oppose each other across the path of the electron beam emitted from the electron gun to the first deflection system with respect to a thickness direction of the flat envelope. In this case, a projecting portion is provided from the peripheral portion of the funnel for molding material.

5 Claims, 13 Drawing Figures

ENVELOPE STRUCTURE FOR FLAT CATHODE RAY TUBE

This application is a continuation of application Ser. No. 322,269 filed Nov. 17, 1981 now abandoned.

BACKGROUND OF THE INVENTION

1. Field of the Invention

This invention relates generally to a flat type cathode ray tube and is directed more particularly to a flat type cathode ray tube which includes a funnel with its envelope having a configuration to improve the reliability thereof.

2. Description of the Prior Art

A prior art flat type cathode ray tube including a flat envelope which consists of a panel and a funnel and an electron gun mounted therein will be now described with reference to FIGS. 1 to 3. Especially, one of the methods of making the funnel thereof will be explained in which a glass plate is heated to be softened and then a cope or upper mold is moved down to the soft glass plate from the upper side thereof to carry out the molding thereof. For example, as shown in FIG. 1, a fixed lower mold or drag 71 having a concave portion 70 is provided. A glass plate 72 to be molded is located thereon to cover the portion 70, a guide wall 73 is disposed thereon, and an upper mold or cope 74 is inserted into the guide wall 73 to be slidably guided. In this case, the cope 74 has an outer configuration corresponding to the inner configuration of the funnel to be finally made. Then, the drag 71, cope 74, guide wall 73 and glass plate 72 are all heated to soften the glass plate 72. Thus, as shown in FIG. 2, by the weight of the glass plate 72 and cope 74 themselves or by the urging force of the cope 74, the glass plate 72 is deformed to be a molded plate or a funnel 1*b* having the configuration corresponding to that of the cope 74.

The funnel 1*b* molded as above has a flat plate portion $\mathbf{1}b_1$, a peripheral wall portion $\mathbf{1}b_2$ thereof and a flange portion $\mathbf{1}b_3$ extended outwards therefrom as shown in FIG. 3. In this case, as the flange portion $\mathbf{1}b_3$ is formed of the glass plate portion gripped by the drag 71 and the guide wall 73 as shown in FIGS. 1 and 2, the peripheral portion of the flange $\mathbf{1}b_3$ is flattened in shape. Therefore, as indicated by a one-dot chain line d in FIG. 3, the unnecessary portion thereof is cut away. Then, the end face of the flange $\mathbf{1}b_3$ is lapped such that a depth D and height H of the funnel 1*b* each become a predetermined value, and that a flat and smooth end surface $\mathbf{1}b_4$ is provided. The end surface $\mathbf{1}b_4$ thus made becomes a surface to be frit-fitted to the panel (not shown). In this case, however, a fine flaw is easily caused in the end surface $\mathbf{1}b_4$ upon the lapping work. If the panel is frit-fitted to the end surface $\mathbf{1}b_4$ of the funnel 1*b* thus made, the above-mentioned fine flaw will become a cause to generate a crack upon heat treating. As a result, the inside of the envelope thus manufactured cannot be kept in high vacuum or an explosion will be caused to lower the reliability of the envelope.

The funnel 1*b* thus made has the flat plate portion $\mathbf{1}b_1$ with the thickness substantially equal to that of the initial glass plate 72, for example, 2.8 mm. However, since the portion of the glass plate 72 corresponding to the peripheral wall portion $\mathbf{1}b_2$ and flange portion $\mathbf{1}b_3$ of the funnel 1*b* are extended to form the flat plate portion $\mathbf{1}b_1$, the thickness of the portions $\mathbf{1}b_2$ and $\mathbf{1}b_3$ are reduced as compared with that of the flat plate portion $\mathbf{1}b_1$ and in addition, scattered, which is substantial especially at the flange portion $\mathbf{1}b_3$. Further, a bent portion $\mathbf{1}b_8$ from the peripheral wall portion $\mathbf{1}b_2$ to the flange portion $\mathbf{1}b_3$ becomes too thin in thickness and can not present sufficient mechanical strength.

OBJECTS AND SUMMARY OF THE INVENTION

Accordingly, it is an object of the present invention to provide a flat type cathode ray tube free from the defects encountered in the prior art.

Another object of the present invention is to provide a flat type cathode ray tube in which the funnel of an envelope is improved in reliability.

A further object of the invention is to provide a flat type cathode ray tube which improves the productivity in working and assembling of the funnel of the envelope.

According to an aspect of the present invention, there is provided a flat type cathode ray tube which comprises:

(a) a flat envelope formed of a panel and a funnel;

(b) a first deflection system composed of a back electrode and a phosphor screen which are both located within said envelope in opposing relation with each other;

(c) a neck portion coupled to said envelope, said neck portion extending in the surface direction of said flat envelope and having therein an electron gun; and (d) a second deflection system formed of electrostatic deflection plates which are so located that they oppose each other across a path of an electron beam emitted from said electron gun to said first deflection system with respect to a thickness direction of said flat envelope, characterized by an escape extended portion provided from a peripheral portion of said funnel for molding material.

The other objects, features and advantages of the present invention will become apparent from the following description, taken in conjunction with the accompanying drawings through which the like references designate the same elements and parts.

DESCRIPTION OF THE PREFERRED EMBODIMENT

Figure 1:
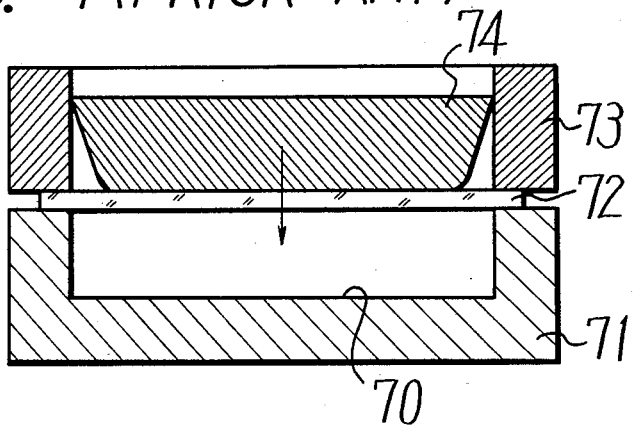
FIG. 1 (PRIOR ART)
FIGS. 1 to 3 are, respectively, cross-sectional views used to explain the process of an example of the prior art molding method for a funnel of an envelope used in a flat type cathode ray tube.
Figure 2:
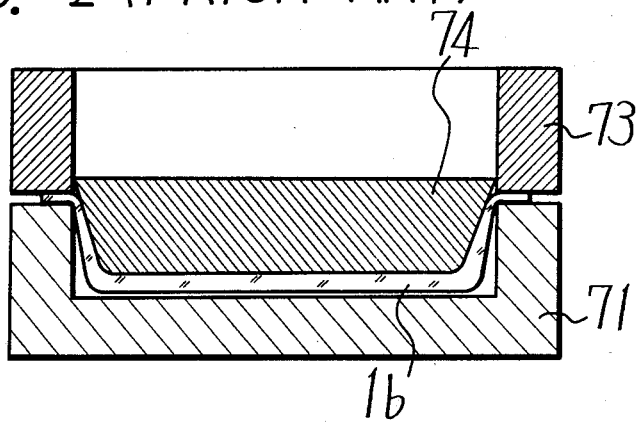
FIG. 2 (PRIOR ART)

The present invention will be hereinafter described with reference to the attached drawings.

An example of the flat type cathode ray tube according to the present invention will be now described with reference to FIGS. 4 and 5 which are, respectively, its plane view and its side view with a part being in cross-section.

This example of the flat type cathode ray tube comprises a flat envelope 1 within which a phosphor screen 2 and a back electrode 3 are located along the flat inside surfaces of the flat envelope 1 in opposing relation.

The flat envelope 1 consists of a flat glass base plate, i.e., panel 1*a*, a glass funnel 1*b* which is fixed to the panel 1*a* at its one surface to define a flat space 10 between the panel 1*a* and the funnel 1*b* and a glass neck tube 1*c* which is coupled to the panel 1*a* and funnel 1*b* at one end thereof extending in the surface direction of the flat space 10 to be communicated therewith and accommodates therein an electron gun 4.

Though not shown in detail, the electron gun 4 may include a cathode, a first grid, a second grid, a third grid and a fourth grid arranged in this order.

Figure 3:
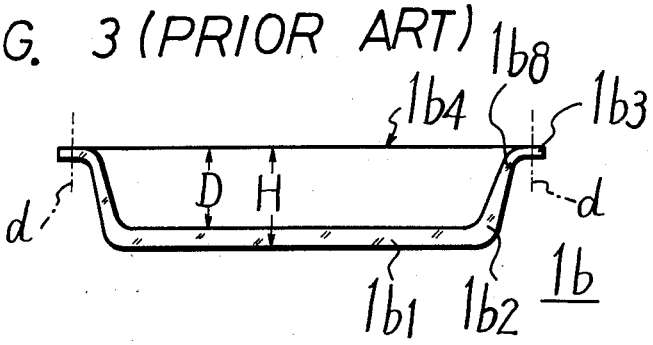
FIG. 3 (PRIOR ART)

The funnel 1*b* consists of a flat plate portion $1b_1$ opposing the panel 1*a*, a peripheral wall portion $1b_2$ extending from the periphery of the flat plate portion $1b_1$ to the panel 1*a* and a flange portion $1b_3$ which is bent outwards from the periphery of the peripheral wall portion $1b_2$, has an end surface $1b_4$ (refer to FIG. 3) frit-fitted to the panel 1*a* and air-tight. The funnel 1*b* has such a configuration or shape that it becomes narrower gradually in width in one side direction seen from its flat plate portion $1b_1$. At the end of the narrow width portion of the funnel 1*b*, the peripheral wall portion $1b_2$ is removed to which is connected integrally, for example, a substantially semi-circular cylindrical portion $1b_7$. One end of the neck tube 1*c* is inserted into the space between the cylindrical portion $1b_7$ and the panel 1*a*, and then the panel 1*a*, funnel 1*b* and neck tube 1*c* are frit-fitted in air-tight manner.

While the panel 1*a* is made to have the configuration corresponding to the peripheral configuration of the funnel 1*b*, the panel 1*a* can be made such that an extending plate portion $1a_1$ is provided at the left or right side of the narrow width portion of the panel 1*a* and extends outside over a high voltage terminal group 11 which passes out from the envelope 1. This extending plate portion $1a_1$ serves to improve the arc discharge path between the high voltage terminal 11 and other portions such as a cabinet when the flat type cathode ray tube is assembled to, for example, the cabinet.

In this case, a conductive layer such as carbon and so on (not shown) is coated on the inner surface of the funnel, i.e., peripheral wall portion $1b_2$ thereof and is supplied with an anode voltage $V_H$.

Coated on the inner surface of the flat panel 1*a*, is, the phosphor screen 2, for example, by the printing method. In this case, a transparent conductive layer is coated on the inner surface of panel 1*a* to form a target electrode 5 on which the phosphor screen 2 is formed, or after the phosphor screen 2 is formed, a metal back made of Al vapor deposition layer is coated on the phosphor screen 2 to form the target electrode 5.

Further, a frame with a window is formed on the portion of the phosphor screen 2 corresponding to the effective picture area, and the above phosphor screen 2 is formed to cover and bridge the frame. The target electrode 5 or phosphor screen 2 is supplied with the high anode voltage $V_H$, while a high voltage lower than the anode voltage $V_H$ is applied to the back electrode 3 to form a first deflection system. A second deflection system is formed in the space between the electron gun 4 and the portion where the phosphor screen 2 is located. This second deflection system functions to deflect the electron beam emitted from the electron gun 4 in both the horizontal and vertical directions. In this case, the horizontal deflection means causes a deflection such that the electron beam emitted from the electron gun 4 is deflected, both in the direction substantially perpendicular to the axis direction of the electron gun 4 and in the surface direction of the phosphor screen 2 to cause the electron beam to produce so-called horizontal scanning on the phosphor screen and the vertical deflection means causes a deflection of the same electron beam in the direction perpendicular to the phosphor screen 2 to cause the beam to produce so-called vertical scanning on the phosphor screen 2 in the direction at right angles to the horizontal scanning direction.

Figure 4:
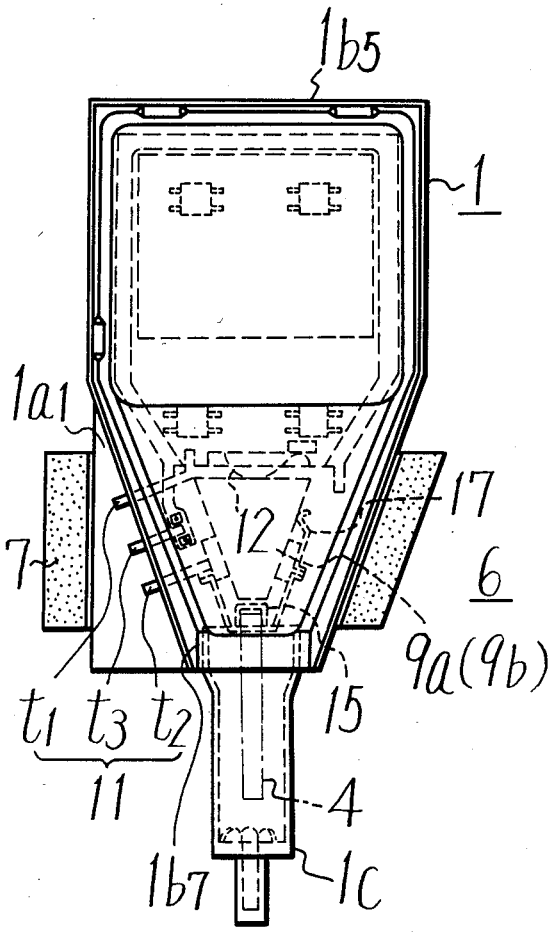
FIG. 4 is a plan view showing an example of the flat type cathode ray tube according to the present invention.
Figure 5:
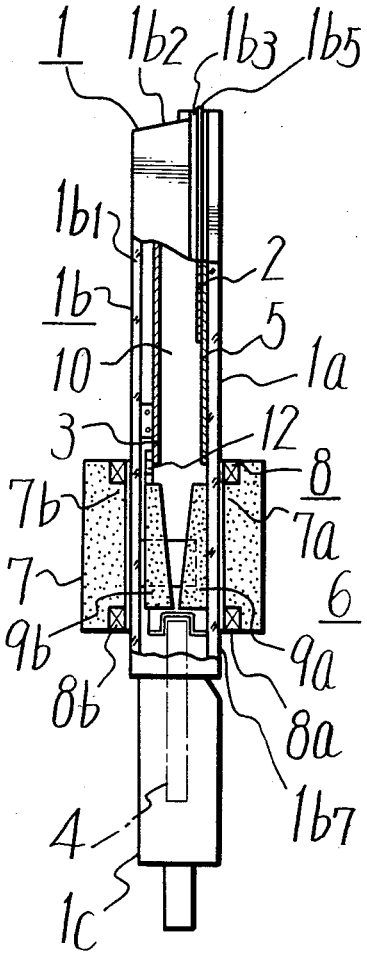
FIG. 5 is a side view thereof with a part being in cross-section.
Figure 6:
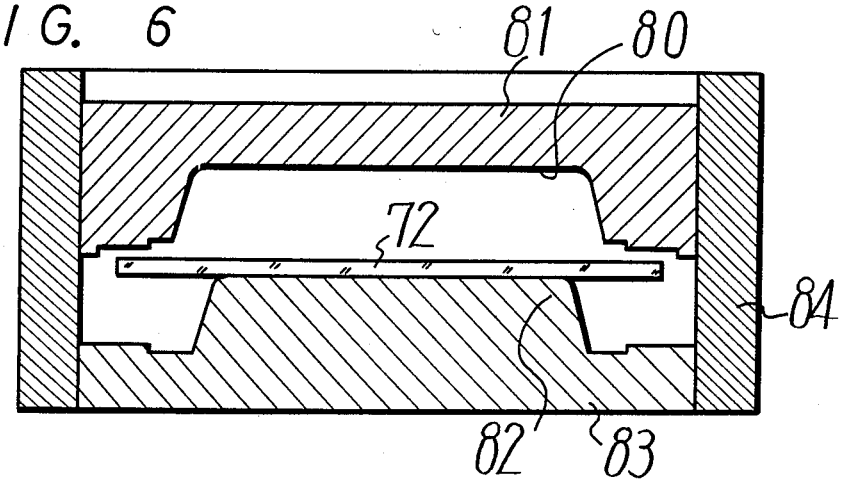
FIGS. 6 to 8 are, respectively, cross-sectional views showing an example of the process to mold a funnel of an envelope used in the flat type cathode ray tube of the invention depicted in FIGS. 4 and 5.

FIGS. 4 and 5, 6 generally show the above horizontal and vertical scanning means, in which the horizontal deflection requiring a relatively large deflection angle is done with electro-magnetic deflection and the vertical deflection is done with electro-static deflection which utilizes, for example, a pair of inner pole pieces which are in the horizontal electro-magnetic deflection, as the electro-static deflection plates.

As shown in the figures, the deflection means 6 consists of an annular magnetic core 7 made of high magnetic permeability material such as ferrite which surrounds the outer periphery of the envelope 1 at the rear stage of the electron gun 4, an electro-magnetic coil 8 ( which includes encased coils 8*a* and 8*b*) through which a horizontal deflection current passes, and a pair of inner pole pieces or electro-static deflection plates 9*a* and 9*b* made of high magnetic permeability material and located within the envelope 1.

Although the magnetic core 7 is of an annular shape to surround the outer periphery of the envelope 1 as set forth above, the magnetic core 7 includes opposing external center poles 7*a* and 7*b* which protrude inwardly in the thickness direction of the envelope 1 and cover the path of the electron beam in the envelope 1. The coils 8*a* and 8*b* are, respectively, coiled on the outer peripheries of the external center poles 7*a* and 7*b* or a coil is coiled on the outer periphery of either one of the external center poles 7*a* and 7*b*. By this arrangement, the magnetic flux caused by the horizontal deflection current flowing through the coil 8 (or 8*a* and 8*b*) is generated between both the external center poles 7*a* and 7*b* to produce the magnetic field across the electron beam path between the inner pole pieces or electrostatic deflection plates 9*a* and 9*b* in the thickness direction of the envelope 1. The inner pole pieces or electro-static deflection plates 9*a* and 9*b* within the envelope 1 oppose each other along the electron beam path at both sides thereof with respect to the thickness direction of the envelope 1, that is, substantially along the flat surface of the envelope 1. In other words, the electro-static deflection plates 9*a* and 9*b* are formed of trapezoidal plates made of high magnetic permeability material which become wider in width as they approach the opposite side of the electron gun 4 of the first deflection system. Thus, the magnetic flux between the outer center poles 7*a* and 7*b* converges in the electron beam path due to the inner pole pieces or electro-static deflection plates 9a and 9b, which are each made of high magnetic permeability material, for example, ferrite having a surface resistivity less than $10^7\Omega$cm, preferably $10^4\Omega$cm. They are used as the electrostatic deflection plates to perform the above vertical deflection for the electron beam. To this end, a vertical deflection signal voltage is applied across the inner pole pieces or electro-static deflection plates 9a and 9b. In this case, one inner pole piece or electro-static deflection plate 9b located at the side of the back electrode 3 of the deflection means 6 is electrically connected to the back electrode 3 through, for example, a conductive spring 12 from which a terminal $t_1$ is led out. This terminal $t_1$ is supplied with a superimposed vertical deflection voltage of a substantially saw-tooth wave form which is varied from a high voltage $V_B$ to $V_B - V_{def}$, for example, 4 KV to 3.75 KV. The other electro-static deflection plate 9a is mechanically connected with the final stage electrode, for example, the fourth grid (anode) of the electron gun 4 and they are electrically connected together by a guide cylinder 15 made of conductive metal and a resilient piece 17 made of conductive metal, from which a terminal $t_2$ is led out and a fixed voltage, for example, 3.875 KV is applied. From the target electrode 5, a terminal $t_3$ is led out and a high voltage, for example, 5 KV is applied. In this case, it may be possible that a voltage of 3.875 KV is applied to the terminal $t_1$ and a voltage of 4 to 3.75 KV is applied to the terminal $t_2$.

As set forth above, due to the cooperation of the first and second deflection systems, the electron beam emitted from the electron gun 4 is capable of scanning the phosphor screen 2 in the horizontal and vertical directions.

Figure 7:
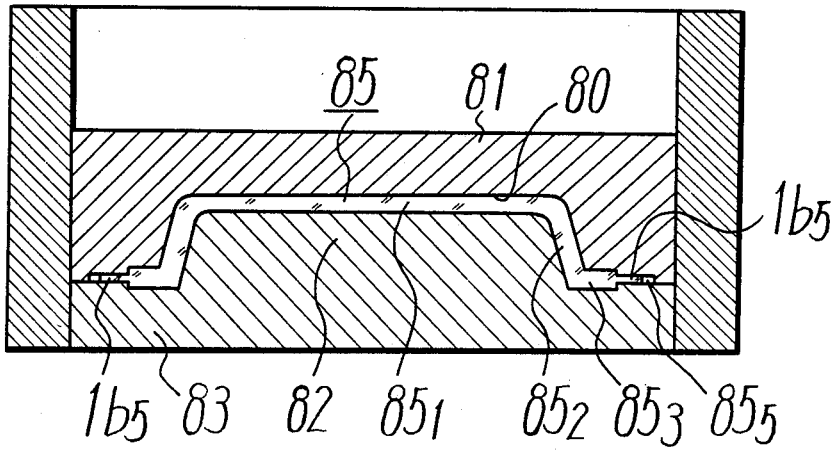

Now, one example of the method for manufacturing the funnel of the envelope for the flat type cathode ray tube according to this invention will be described with reference to FIGS. 6 to 8. With this method, as shown in FIG. 6, an upper mold or cope 81 having a concave portion 80 which is made of carbon and a lower mold or drag 83 having a convex portion 82 and which is made of carbon are prepared. A guide wall 84 is also prepared for restricting the relative positions of the cope 81 and the drag 83. In this case, the guide wall 84 is constructed integrally with or mechanically coupled to, for example, the drag 83 and both are held together in a fixed state.

The cope 81 is movable. When the cope 81 and the drag 83 are engaged in the guide wall 84, a cavity 85 is defined therebetween as shown in FIG. 7. This cavity 85 is positioned adjacent the upper surface of the convex 82. In detail, this cavity 85 includes a flat cavity or space $85_1$, which serves to form the flat plate portion $1b_1$ of the finished funnel 1b, an inclined cavity or space $85_2$, communicates with the space $85_1$ is positioned on the peripheral surface of the convex 82, and has a configuration corresponding to the peripheral configuration of the funnel 1b and has a substantially U-shaped pattern (not shown in the figure) except for the portion which will become the cylindrical portion $1b_7$ explained in connection with FIGS. 4 and 5 and serves to form the peripheral wall portion $1b_2$ of the funnel 1b. A flange-shaped cavity or space $85_3$, which communicates with and extends outwards from the inclined space $85_2$ serves to form the flange portion $1b_3$ of the funnel 1b. The cavity 85 further includes an extended cavity or space $85_5$ which is extended outwards from the space $85_3$ which is not flush with the space $85_3$ on the bottom surface and has a bottom surface above the space $85_3$ and the thickness thereof is thinner than that of the space $85_3$.

A glass plate is molded by the cope 81 and the drag 83 constructed as above to provide a desired funnel. To this end, as shown in FIG. 6, a glass plate 72, for example, a sodium glass plate having a thickness of about 2.8 to 3 mm is located on the convex portion 82 of the drag 83 so as to lie over at least all of the convex portion 82 and to extend outwardly therefrom. In this case, the glass plate 72 is so prepared that the thickness and flatness thereof are accurate and the volume of the glass plate 72 is selected to be less than that of the cavity 85 but larger than the total volume of the spaces $85_1$, $85_2$ and $85_3$ of the cavity 85. Then, the cope 81, drag 83 and guide wall 84 and the glass plate 72 are all heated up to about 1000° C. to soften the glass plate 72 and the cope 81 is moved downwardly to be near the drag 83 or, for example, the cope 81 is relatively moved down by gravity so it approaches the drag 83 and makes contact therewith and defines the space 85 therebetween. Thus, the softened glass plate 72 is deformed and pressed to fill the spaces $85_1$ and the peripheral spaces $85_2$, $85_3$ and space $85_5$ of the cavity 85 to form a projecting portion $1b_5$ in addition to the flat plate portion $1b_1$ and other parts of the funnel portion 1b. After the heat molding described, the cope 81, drag 83 and other parts are gradually cooled and the cope 81 and drag 83 are separated from each other and the molded body is removed. In this case, the portions of the upper and down molds or cope and drag corresponding to the peripheral wall portion $1b_2$ of the funnel 1b are inclined by 5° to 15°, preferably less than 12° with respect to the vertical. Since the amount of carbon is small in $\alpha$ (thermal expansion factor) as compared with glass, during the gradual cooling the molded glass is separated from the drag. At the same time, the cope is moved upwardly. At that time, a little gap is formed between the peripheral portion of the molded glass body and the cope. In this manner, the funnel 1b is provided which has the flat plate portion $1b_1$, the peripheral wall portion $1b_2$ and the flange portion $1b_3$ with the shapes corresponding to the inner shapes of the spaces $85_1$, $85_2$ and $85_3$ of the cavity 85 and also has the projected portion $1b_5$ which is thin which corresponds to the space $85_5$ which extends outwardly from the space $85_3$, as shown in FIG. 8. Since it is likely that the extending length of the projecting portion $1b_5$ is not always equal throughout the respective portions thereof, the projecting portion $1b_5$ is cut away as shown by the one-dot chain line e in FIG. 8 so that it has the same extending length at all portions thereof.

The funnel 1b thus finally obtained is shown in FIGS. 9 to 13 in which the parts corresponding to those of FIGS. 4 and 5 are marked with the same reference numerals. As shown in the figures, the funnel 1b includes the flat plate portion $1b_1$, the peripheral wall portion $1b_2$ which extends from the peripheral portion to the panel 1a (refer to FIGS. 4 and 5) and the flange portion $1b_3$ which extends outwardly from the end edge of the peripheral wall portion $1b_2$ and which also has a funnel shape such that its width becomes gradually narrower to one side as seen from the flat plate portion $1b_1$. At the narrowest end of the funnel 1b no peripheral wall portion $1b_2$ is provided, and at that end, there is provided a substantially semi-circular cylindrical portion $1b_7$.

In the funnel 1*b* thus molded, the flat plate portion $1b_1$ thereof, which forms the main surface, is made of the undeformed glass plate 72 and the peripheral portions of the glass plate 72 are formed downwardly and deformed so as to have the predetermined shape. In this case, since the extended space $85_5$ is provided in communication with the cavity 85 along the peripheral edge in space $85_3$, the excess glass material can overflow into the space $85_5$. Thus, no mold distortions occur at respective portions and the respective portions of the funnel 1*b* can be molded with a thickness corresponding to the respective spaces $85_1$, $85_2$ and $85_3$ of the cavity 85 which is previously defined by the cope 81 and drag 83. That is, non-unformity will not be caused in the respective portions which have the given thickness, shapes and sizes and the funnel 1*b* having the necessary mechanical strength in addition to the above advantages can be made with high yields.

According to the molding method mentioned above, the molded body having a configuration for forming the cavity 85 can be manufactured. Therefore, during assembling the respective parts to the funnel 1*b*, an abutting portion $1b_6$ used to position the funnel 1*b* with a jig and a groove $1b_8$ for leading out the high voltage terminal 11 can be formed at the same time that the funnel 1*b* is molded.

Further, according to the method described above, if the size and shape of the respective parts and hence the height H and the depth D of the funnel 1*b* are molded as designed, it becomes unnecessary to cut and abrade or calendar the end surface $1b_4$ of the flange portion $1b_3$ of the funnel 1*b*. Accordingly, mass production becomes possible and such processes can be omitted. Further, the generation of cracks during the frit-bonding of the funnel 1*b* to the panel 1*a* is caused by flaws, distortion and so on, which are generated during cutting and abrasion and these will be effectively avoided.

Figure 8:
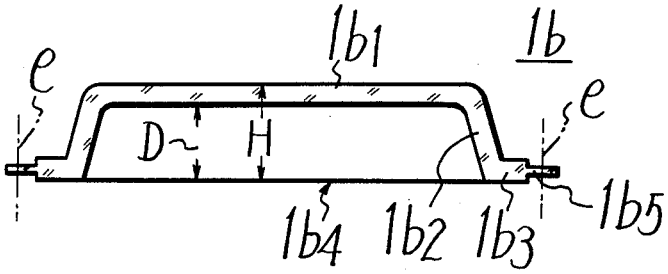
Figure 9:
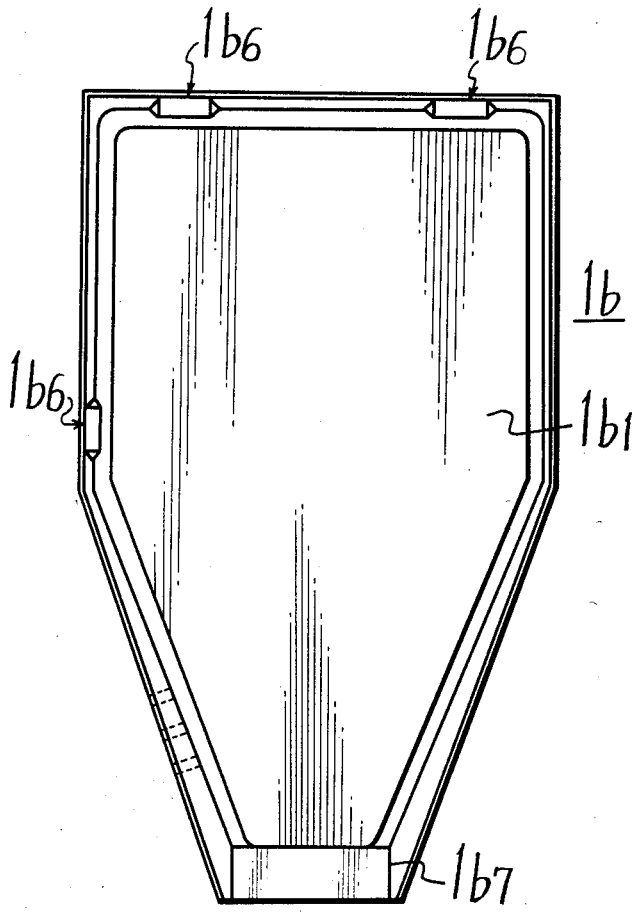
FIG. 9 is a plan view of the funnel made by the process shown in FIGS. 6 to 8.
Figure 10:
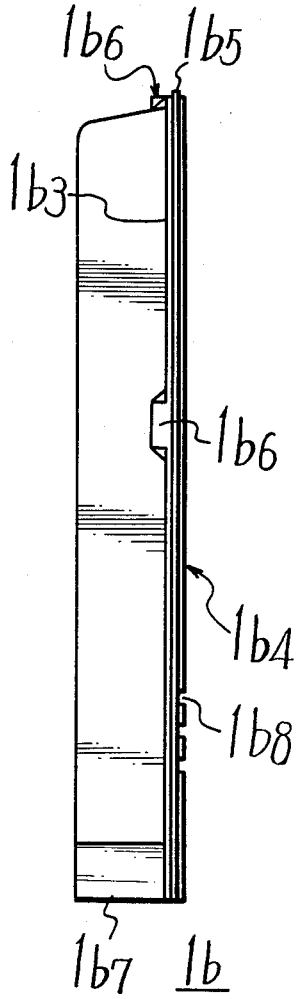
FIG. 10 is a side view of FIG. 9.
Figure 11:
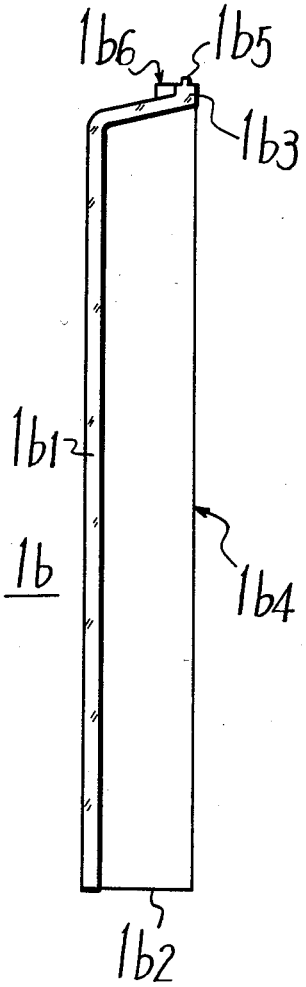
FIG. 11 is a cross-sectional view of FIG. 9.
Figure 12:
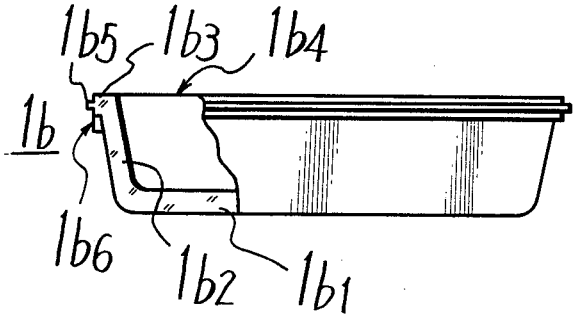
FIG. 12 is a side view of FIG. 7 at the opposite side of FIG. 10 with a part being shown in crosssection.
Figure 13:
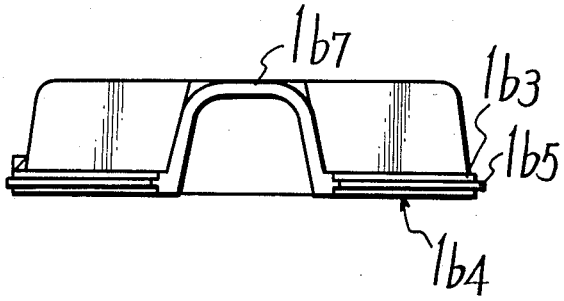
FIG. 13 is a side view of FIG. 9 at the side different from FIGS. 10 and 12.

Further, in this invention, since the projecting portion $1b_5$ for the molding material is provided with a surface which is different from the end surface $1b_4$ as set forth above, when a part of the projecting portion $1b_5$ is cut away as shown by the one-dot chain line e in FIG. 8, no work distortion caused by cutting remains on the surface, $1b_4$, of the funnel 1*b* which is to be frit-bonded to the panel 1*a*. Thus, no cracks have been generated with the method of the invention, the reliability of the envelope will be greatly improved.

Further, according to the flat type cathode ray tube of the present invention, the positional relationship between the back electrode 3 and the phosphor screen 2 may be selected to be such that the back electrode is located at the side of the panel 1*a* and the phosphor screen 2 is located at the side of the funnel 1*b* or the back electrode 3 is made of a transparent electrode through which a picture can be watched according to the invention.

The above description is given for a single preferred embodiment of the invention, but it will be apparent that many modifications and variations could be effected by one skilled in the art without departing from the spirits or scope of the novel concepts of the invention, so that the scope of the invention should be determined by the appended claims only.

We claim as our invention:

1. A flat type cathode ray tube, comprising, a flat envelope formed of a flat panel and a dish-shaped funnel, said glass dish-shaped funnel formed with a flange portion about its periphery, a first deflection system composed of a back electrode and a phosphor screen which are both located within said envelope in opposing relation to each other, a neck portion coupled to said envelope, said neck portion extending in the surface direction of said flat envelope and having therein an electron gun, and a second deflection system formed of electro-static deflection plates which are so located that they oppose each other and mounted on opposite sides of a path of an electron beam emitted from said electron gun and mounted between said first deflection system and said electron gun, said flat envelope having a projecting portion which extends from the outer edge of said flange portion and said projecting portion being thinner than the body of said flange portion, and being the same material as said funnel and said projecting portion having surfaces which are offset from the surfaces of said flange portion which is sealed to said panel, wherein when said projecting portion is cut work stresses are not set up in said flange.

2. A flat type cathode ray tube as claimed in claim 1, wherein an abutting portion is provided at a peripheral portion of said funnel for restricting the relative position between said funnel and said panel.

3. A flat type cathode ray tube as claimed in claim 1, wherein grooves are provided on a part of a sealing surface of said funnel with said panel for leading out therethrough at least one of the high voltage terminals.

4. A flat type cathode ray tube as claimed in claim 1, wherein said projecting portion is lapped on its end surface.

5. A flat type cathode ray tube as claimed in claim 1, wherein said dish-shaped funnel has outwardly extending side walls at an angle in the range of 5 to 15 degrees from vertical.

* * * * *